US007097189B2

(12) United States Patent
Hsu

(10) Patent No.: US 7,097,189 B2
(45) Date of Patent: Aug. 29, 2006

(54) WHEELCHAIR WITH SELF-RAISING SEAT

(75) Inventor: Chin-Lu Hsu, Taipei (TW)

(73) Assignee: Lloyd Linden, Inc., Taipei (TW)

( * ) Notice: Subject to any disclaimer, the term of this patent is extended or adjusted under 35 U.S.C. 154(b) by 215 days.

(21) Appl. No.: 10/714,622

(22) Filed: Nov. 18, 2003

(65) Prior Publication Data

US 2005/0104332 A1 May 19, 2005

(51) Int. Cl.
*A61G 5/00* (2006.01)

(52) U.S. Cl. ..... 280/250.1; 280/647; 297/DIG. 4; 297/DIG. 10

(58) Field of Classification Search ..... None
See application file for complete search history.

(56) References Cited

U.S. PATENT DOCUMENTS 4,456,086 A * 6/1984 Wier et al. ..... 180/11
4,598,944 A * 7/1986 Meyer et al. ..... 297/183.9
4,640,525 A * 2/1987 Jensen et al. ..... 280/642
5,096,008 A * 3/1992 Mankowski ..... 180/6.5
5,195,803 A * 3/1993 Quintile ..... 297/365
5,520,403 A * 5/1996 Bergstrom et al. ..... 280/250.1
5,556,121 A * 9/1996 Pillot ..... 280/304.1
5,772,226 A * 6/1998 Bobichon ..... 280/250.1
6,125,957 A * 10/2000 Kauffmann ..... 180/65.1
6,601,869 B1 * 8/2003 Porcheron ..... 280/648
6,793,232 B1 * 9/2004 Wing ..... 280/304.1
2003/0146601 A1 * 8/2003 Gutierrez
2003/0197345 A1 * 10/2003 Nelson et al.

* cited by examiner

*Primary Examiner*—Christopher P. Ellis
*Assistant Examiner*—Christopher Bottorff
(74) *Attorney, Agent, or Firm*—Rosenberg, Klein & Lee

(57) ABSTRACT

A wheelchair having two rigid frames, two fixing combinations, two lever combinations and a transformation combination is provided. The rigid frame is connected to a wheel and has a front cross frame coupled between the rigid frames. The fixing combinations further include a linking frame and tooth frame, whereby the linking frame enfolds the tooth frame and couples to the rigid frame. The tooth frame includes a tooth fitting. The lever combination is located at the top of the rigid frame and further includes a rear cross frame coupled between the lever combination of lever. The raising wheelchair provides assistance to users for stable, convenient, and independent operation in rising from or sitting into the chair.

18 Claims, 5 Drawing Sheets

WHEELCHAIR WITH SELF-RAISING SEAT

BACKGROUND OF THE INVENTION

1. Field of the Invention

The present invention relates to a wheelchair, more specifically, the present invention discloses a wheelchair with raising seat for assisting users in standing and seating which improves a user's independence and safety.

2. Description of the Prior Art

Wheelchairs are a necessary form of transportation for injured patients in daily life. Wheelchairs are particularly useful for seriously injured or disabled persons, who without the wheelchair would be unable to be mobile.

However, a major concern to users is their safety while rising from or sitting into the chair. Typically, another person must assist the chair user while they are rising or sitting. Additionally, the assisting person must lift the body weight of the user while trying to keep the chair stable. Unfortunately, this often can not safely be accomplished, resulting in the chair user slipping or falling or the chair becomes unstable and crashes into nearby objects or bystanders.

As shown above, it is critical to protect users when they are rising or sitting and ensure their safety. Failing or slipping while exiting the chair not only can lead to further injury to the user, but also is embarrassing and lowers the user's confidence. Additionally, if the user is heavy, an assisting person can easily strain muscles or hurt themselves while helping the user rise.

Therefore, there is need for an improved wheelchair that can provide a self-raising support for assisting users and a fixing position for preventing instability.

SUMMARY OF THE INVENTION

It is an object of the present invention to provide a stable raising wheelchair, which can assist users in independently, conveniently, and stably operating the seat position by themselves.

Another object of the present invention is to provide a safe raising wheelchair, which provides support while users change their position and prevents swinging.

Another object of the present invention is to provide a self operatable wheelchair, which can eliminate the need for assistance and increases a user's confidence.

It is to be understood that both the foregoing general description and the following detailed description are exemplary, and are intended to provide further explanation of the invention as claimed.

DETAILED DESCRIPTION

Figure 1:
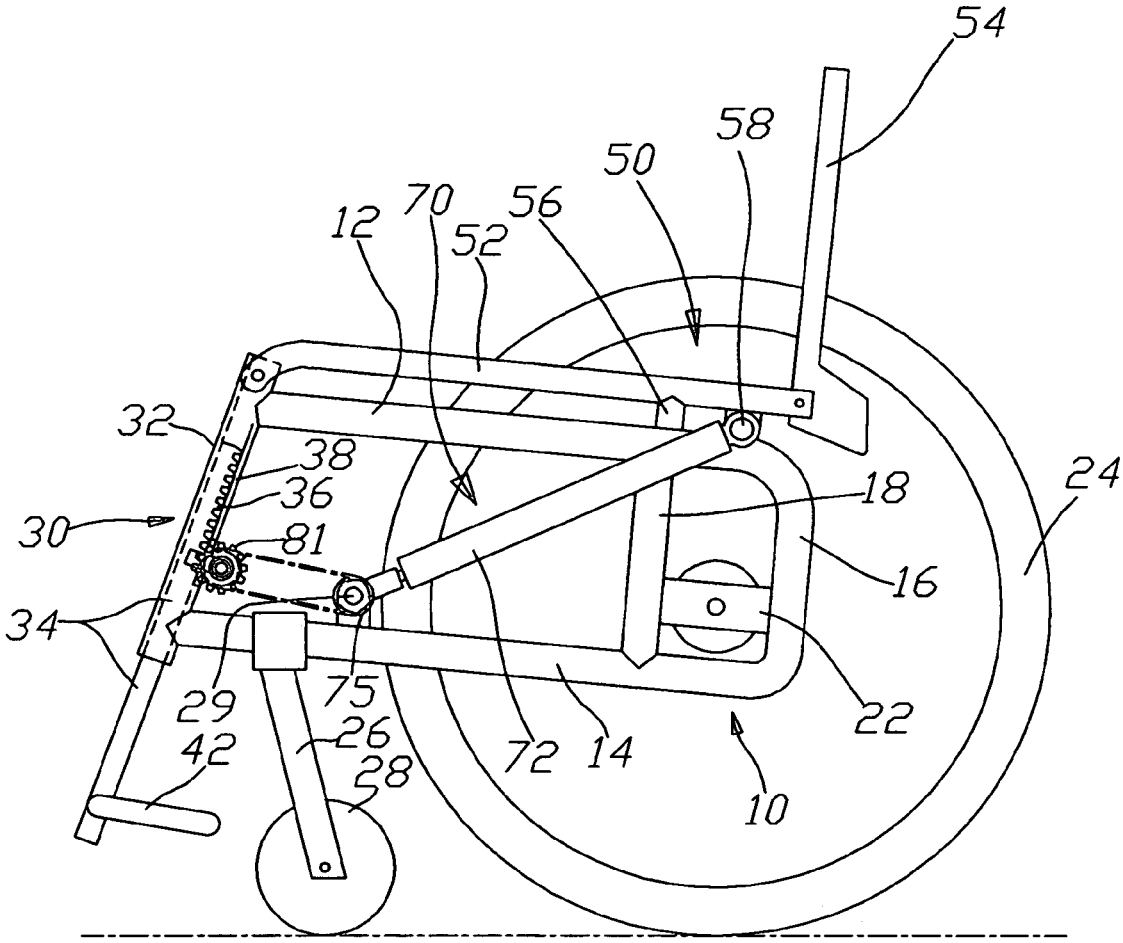
FIG. 1 is a side view of a wheelchair according to an embodiment of the present invention, when the wheelchair is in a seating position.

Reference will now be made in detail to the preferred embodiments of the present invention, examples of which are illustrated in the accompanying drawings. Wherever possible, the same reference numbers are used in the drawings and the description to refer to the same or like parts.

Figure 2:
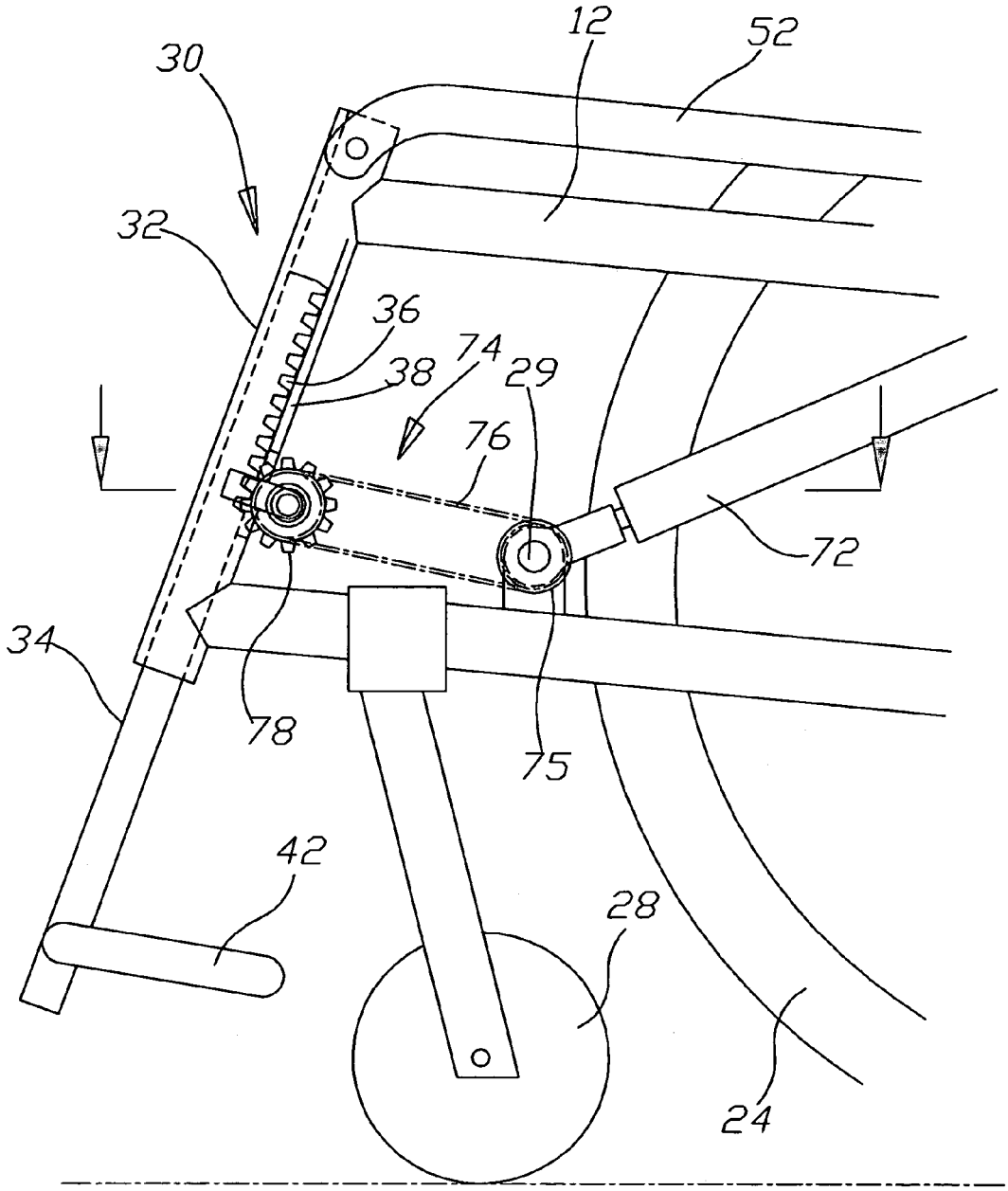
FIG. 2 is a side view of a fixing section of a wheelchair according to an embodiment of the present invention.
Figure 3:
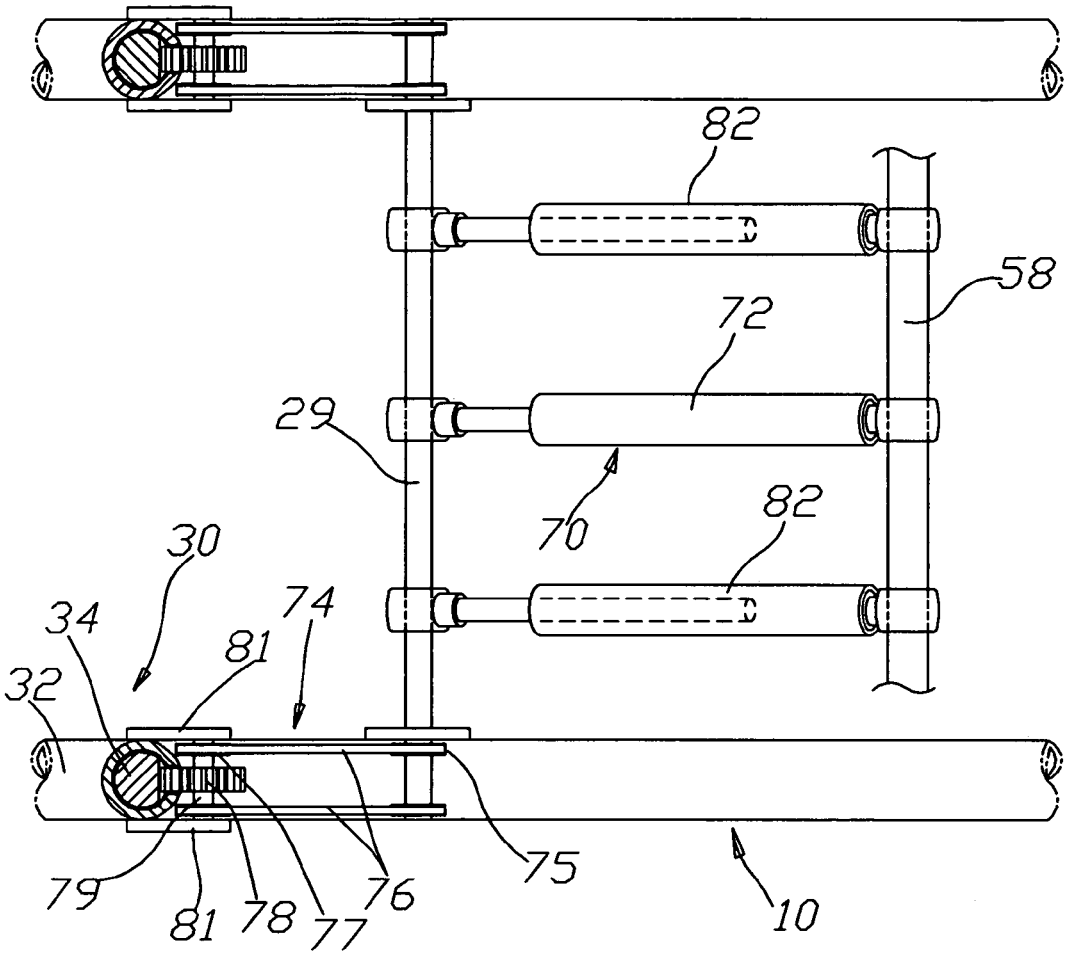
FIG. 3 is a top view showing the frame with gas spring according to an embodiment of the present invention.

Refer to FIGS. 1, 2 and 3. The raising wheelchair comprises two rigid frames 10, whereby the rigid frame 10 further comprises an upper frame 12, a lower frame 14 and a side vertical frame 16, formed curved and connected to said frame.

A vertical frame 18 is located between upper frame 12 and lower frame 14. A vertical cross major wheel frame 22 couples between the vertical frame 18 and side vertical frame 16, whereby the vertical cross major wheel frame 22 further connects to wheel 24. A front wheel frame 26 couples to the bottom of the lower frame 14 at an appropriate location. A fixing combination 30 is located at the front of the upper frame 12 and the lower frame 14, whereby the fixing combination 30 further has a linking frame 32 and a tooth frame 34.

The fixing combination 30 couples to the upper frame 12 and the lower frame 14 to form a frame body. The linking frame 32 is a hollow tube, which contains a tooth frame 34 with teeth fittings 36 on the rear side of the tooth frame 34.

The tooth frame 34 further comprises a tooth groove 38 arranged in relation to the teeth fittings 36, for linking. At the appropriate location of the tooth frame 34 a frame stop 42 is provided as a stop.

Figure 4:
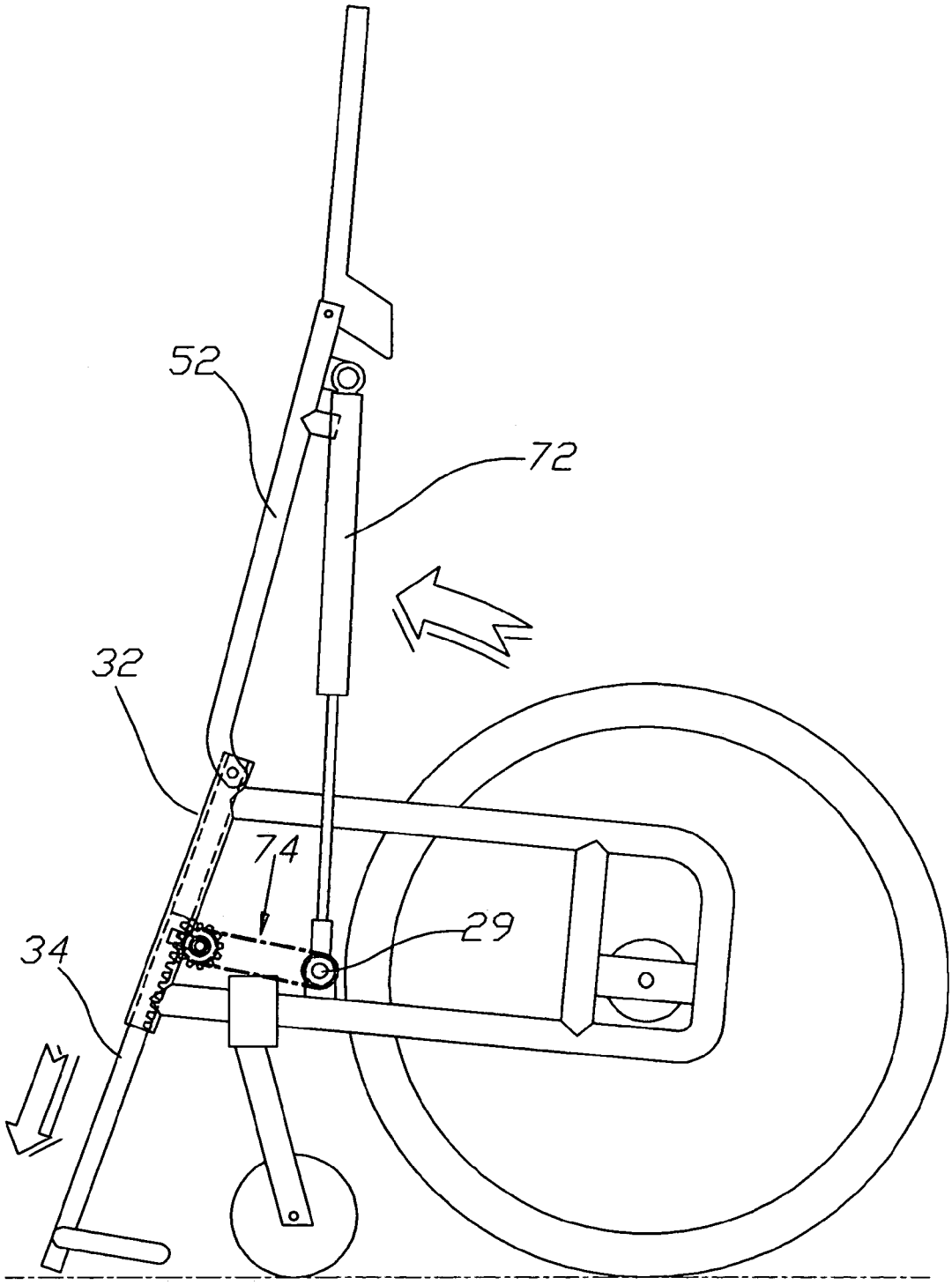
FIG. 4 is a side view of a wheelchair according to an embodiment of the present invention, when the wheelchair is in a raised position.

The invention further comprises a lever combination 50 at the top of the rigid frame 10, whereby the, lever combination 50 comprises an arm bar 52 and a lever bar 54. The arm bar 52 can also support or hold a seat cushion. One endpoint of the lever combination 50 couples to the linking frame 32, and another endpoint of the lever combination 50 couples to the lever bar 54. The lever bar 54 and arm bar 52 pivot for holding lever bar 54 at an appropriate angle between a sitting and a raised position of the chair, as shown in FIGS. 1 and 4.

A tab stop 56 is provided at an appropriate location on the arm bar 52 for contacting the rigid frame 10. A rear cross frame 58 is arranged between the two arm bars 52.

An upright combination 70 comprises a gas spring 72 and a transformation combination 74, whereby the gas spring 72 is connected to the front cross frame 29 at one endpoint and connected to the rear cross frame 58 at the other endpoint. The transformation combination 74 comprises a rear gear 75, a chain 76, middle gear 77 and front gear 78. The rear gear 75 couples to the front cross frame 29 at one endpoint, and the middle gear 77 and front gear 78 couple to axial frame 79 which is position in the frame bearing 81 separated from the linking frame 32. The rear gear 75 is connected to the chain 76 and middle gear 77, further linking to the front gear 78 geared to the teeth fittings 36 of the tooth frame 34.

Alternatively, without the chain 76, said rear gear 75 can gear directly to the middle gear 77 thus the rear gear 75 further gears the front gear 78.

Furthermore, between the front cross frame 29 and the rear cross frame 58 a shaft support 82 is provided for increasing the stability when changing positions and responding to control by the transformation combination 74.

Refer to FIG. 4 showing the wheelchair in a raised position. As shown in the drawing, the arm bar 52 is raised by the gas spring 72 which is coupled to the transformation combination or gear set 74. Additionally, since the transformation combination 74 is geared to the teeth 36 of the tooth frame 34, the tooth frame 34 and frame stop 42 move in a downward direction to the ground.

In use, up-right support can be utilized from the arm bar 52 by the user. Such support decreases the bearing weight for assistance and the guide of the tooth frame 34 against the ground prevents instability and changing positions of the chair. Finally, the gearing by combination of the transformation combination 74, the rear gear 75, and the chain 76 can smoothly achieve the above process.

Figure 5:
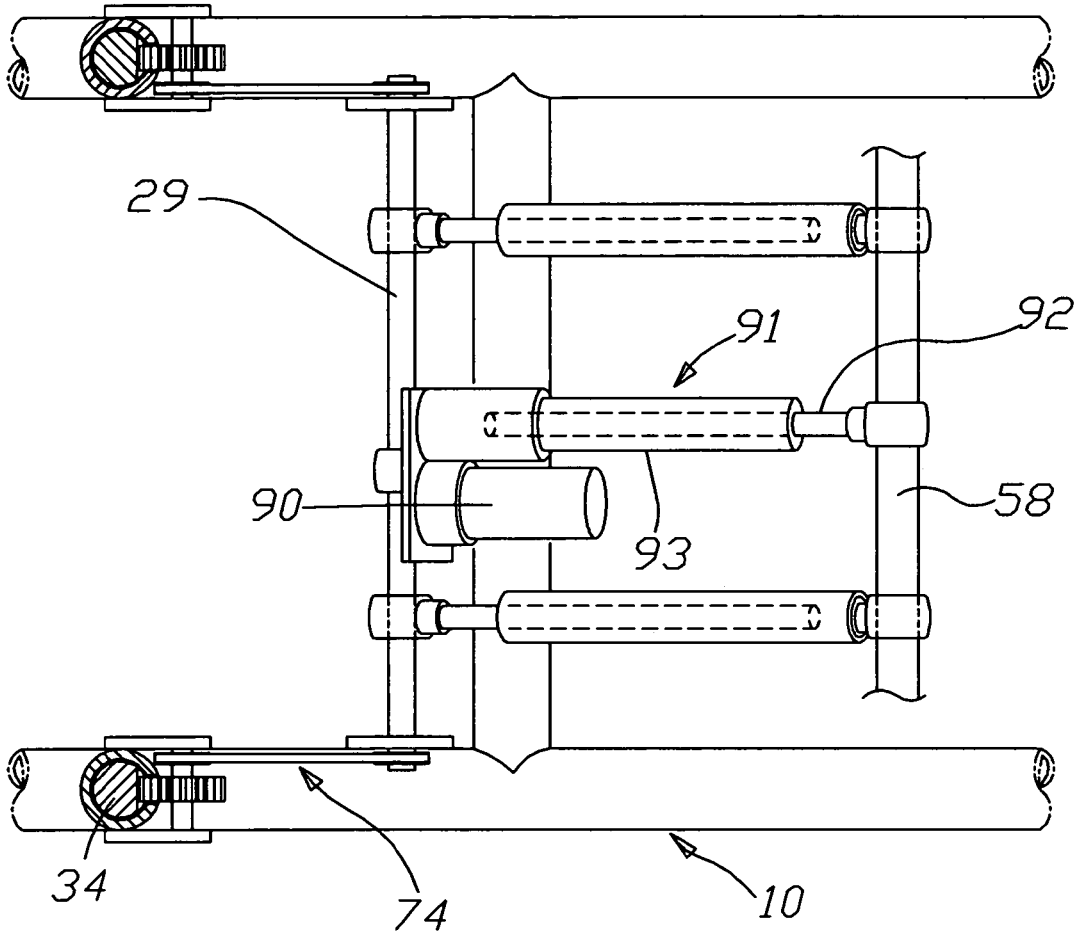
FIG. 5 is a top view illustrating another example of the frame with gas spring according to an embodiment of the present invention.

Refer to FIG. 5, which is another embodiment of the present invention. In this embodiment, a motor 90 is arranged between the rigid frames 10. The motor 90 provides a drive force to a gas spring 91. One endpoint of the gas spring 91 couples to the front cross frame 29, and the other endpoint of the gas spring 91 couples to the rear cross frame 58. The rear cross frame 58 comprises a longitudinal shaft 92 and a shaft cover 93 covering the outside of longitudinal shaft 92. The shaft of the longitudinal shaft 92 and shaft cover 93 are transformed by the motor's 90 drive extending the gas spring 91, causing the arm bar to rise. The front cross frame 29 is turned by extending of the gas spring 91 and the tooth frame 34 is turned downward to the ground, guided by the transformation combination 74.

Addition of the motor further increases the facility for changing the wheelchair's position easily, conveniently, and safely.

It will be apparent to those skilled in the art that various modifications and variations can be made to the present invention without departing from the scope or spirit of the invention. In view of the foregoing, it is intended that the present invention cover modifications and variations of this invention provided they fall within the scope of the invention and its equivalent.

What is claimed is:

1. A raising wheelchair comprising:

two rigid frames, each connected to a separate wheel, further comprising a front cross frame coupled between said rigid frames;

two fixing combinations, each fixing combination comprising a linking frame and a tooth frame on respective sides thereof, whereby each linking frame is coupled to a respective rigid frame and enfolds a corresponding tooth frame, the tooth frame comprising a tooth fitting;

two lever combinations respectively coupled and located at a top of said rigid frames;

a rear cross frame coupled between said lever combinations;

a pair of transformation combinations respectively coupled to said lever combinations, said transformation combinations being respectively geared to said tooth frames, and a motor, located between said rigid frames for driving said transformation combinations.

2. The wheelchair of claim 1, whereby each transformation combination further comprises a chain located between said front cross frame and said rear cross frame.

3. The wheelchair of claim 1, whereby each linking frame comprises a tooth grove appropriately located in relationship to said tooth fitting of said corresponding tooth frame.

4. The wheelchair of claim 1, further comprising a frame stop coupled to each said tooth frame for stopping.

5. The wheelchair of claim 1, whereby each lever combination further comprises an arm bar and a lever bar, said arm bar being pivotally secured between a respective linking frame and said lever bar.

6. The wheelchair of claim 5, whereby the lever bar and arm bar pivot at an angle between a sitting and a raised position of the wheelchair.

7. The wheelchair of claim 5, said arm bar comprising a tab stop for stopping against a respective rigid frame.

8. The wheelchair of claim 1, whereby each transformation combination further comprises at least one gear for gearing to a respective tooth fitting of said corresponding tooth frame.

9. The wheelchair of claim 8, whereby each transformation combination further comprises at least one chain for receiving and guiding said gear thereof.

10. The wheelchair of claim 1, further comprising a shaft support to couple between said front cross frame and said rear cross frame for increasing the stability when changing positions.

11. A raising wheelchair comprising:

two rigid frames, each connected to a separate wheel, with a front cross frame coupled between said rigid frames;

two fixing combinations, the fixing combinations comprising a linking frame and a tooth frame, whereby each linking frame is coupled to a respective rigid frame and encases a corresponding tooth frame, and whereby the tooth frame comprises a tooth fitting;

two lever combinations respectively coupled and located at a top of said rigid frames;

at least one rear cross frame coupled between said lever combinations; and a pair of transformation combinations respectively coupled to at least one gas spring of said lever combinations for providing support to change a position of said wheelchair, each transformation combination being respectively geared to said tooth frames.

12. The wheelchair of claim 11, whereby the gas spring is locate between said front cross frame and said rear cross frame.

13. The wheelchair of claim 11, whereby each linking frame comprises a tooth grove located in relation to said tooth fitting of said corresponding tooth frame.

14. The wheelchair of claim 11, whereby each transformation combination further comprises at least one gear for gearing to a respective tooth fitting of said corresponding tooth frame.

15. The wheelchair of claim 14, whereby each transformation combination further comprises at least one chain for receiving said gear thereof.

16. A raising wheelchair comprising:

a frame body including (a) two rigid frames, (b) two linking frames, whereby the linking frames each comprise a tooth frame, and (c) a gas spring;

two lever combinations located at a top of said rigid frames; and a transformation combination coupled to said frame body and guided by said two lever combinations, the transformation combination being geared to said tooth frames, one endpoint of said gas spring being coupled to said lever combination and another endpoint of said gas spring being coupled to the transformation combination.

17. A raising wheelchair comprising:

a wheeled-frame body, comprising two rigid frames and two linking frames, a cross shaft coupled between said rigid frames, two lever combinations respectively located at tops of said rigid frames, a motor coupled to said wheel-frame body, and a pair of gas springs for extending, guided by said motor, whereby the gas springs respectively drives said lever combinations, whereby one endpoint of each gas spring is coupled to a respective lever combination and another endpoint of said gas spring is coupled to said cross shaft.

18. The wheelchair of claim 17, whereby each gas spring further comprise a longitudinal shaft and a shaft cover, whereby the shaft cover encases at least a portion of an outside of said longitudinal shaft.

* * * * *